US011686205B2

(12) United States Patent
Delahaye et al.

(10) Patent No.: US 11,686,205 B2
(45) Date of Patent: Jun. 27, 2023

(54) ANGULAR SECTOR FOR TURBOMACHINE BLADING WITH IMPROVED SEALING

(71) Applicant: SAFRAN AIRCRAFT ENGINES, Paris (FR)

(72) Inventors: Thomas Nolwenn Emmanuel Delahaye, Moissy-Cramayel (FR); Kamel Benderradji, Moissy-Cramayel (FR); Alain Marc Lucien Bromann, Moissy-Cramayel (FR); Liliana Gomes Pereira, Moissy-Cramayel (FR); Delphine Hermance Maxime Parent, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/056,738

(22) PCT Filed: May 22, 2019

(86) PCT No.: PCT/FR2019/051159

§ 371 (c)(1),
(2) Date: Nov. 18, 2020

(87) PCT Pub. No.: WO2019/224476

PCT Pub. Date: Nov. 28, 2019

(65) Prior Publication Data

US 2021/0207488 A1 Jul. 8, 2021

(30) Foreign Application Priority Data

May 23, 2018 (FR) ..... 1854334

(51) Int. Cl.
*F01D 11/00* (2006.01)
*F01D 11/12* (2006.01)

(52) U.S. Cl.
CPC ..... *F01D 11/001* (2013.01); *F01D 11/127* (2013.01); *F05D 2250/182* (2013.01);
(Continued)

(58) Field of Classification Search
CPC ..... F01D 11/001; F01D 11/12; F01D 11/127; F01D 9/02; F01D 9/04; F01D 11/122;
(Continued)

(56) References Cited

U.S. PATENT DOCUMENTS 4,295,785 A 10/1981 Lardellier
4,623,298 A * 11/1986 Hallinger ..... F01D 11/12 415/139

(Continued)

FOREIGN PATENT DOCUMENTS

EP 0017534 A1 10/1980
EP 1229213 A1 8/2002

(Continued)

OTHER PUBLICATIONS

English Translation of the Written Opinion of the International Searching Authority dated Sep. 17, 2019, issued in corresponding International Application No. PCT/FR2019-051159, filed on May 22, 2019, 5 pages.

(Continued)

*Primary Examiner* — Devon C Kramer
*Assistant Examiner* — Kelsey L Stanek
(74) *Attorney, Agent, or Firm* — Christensen O'Connor Johnson Kindness PLLC

(57) ABSTRACT

An angular sector of a fixed blade ring of a turbomachine, in particular a stator or a guide vane assembly, includes, relative to the axis of said fixed blade ring, a radially outer platform, a radially inner platform, at least two blades extending between said platforms, and at least one block of abradable honeycomb material extending on the inside of the inner platform between transverse ends of the sector. The block of abradable material includes at least one transverse end wall shaped according to a toothed profile having at least one radially oriented tooth extending across an entire radial thickness of said block.

10 Claims, 4 Drawing Sheets

(52) U.S. Cl.
CPC .. *F05D 2250/183* (2013.01); *F05D 2250/283* (2013.01); *F05D 2260/36* (2013.01)

(58) Field of Classification Search
CPC ..... F01D 11/125; F05D 2250/182; F05D 2250/183; F05D 2250/283; F05D 2260/36
USPC ..... 415/173.4, 174.4
See application file for complete search history.

(56) References Cited

U.S. PATENT DOCUMENTS

2002/0106276 A1* 8/2002 Tomita ..... F01D 5/225 415/173.3
2011/0241295 A1* 10/2011 Voisine ..... F04D 29/083 277/500
2014/0205444 A1* 7/2014 Zheng ..... F01D 11/04 415/173.1
2016/0273380 A1* 9/2016 Stiehler ..... F01D 21/04
2018/0258784 A1* 9/2018 Schlothauer ..... F04D 29/164
2018/0355745 A1* 12/2018 Mathew ..... F01D 11/001

FOREIGN PATENT DOCUMENTS

FR 2552159 A1 3/1985
JP 2008180149 A 8/2008

OTHER PUBLICATIONS

International Search Report dated Sep. 17, 2019, issued in corresponding International Application No. PCT/FR2019/051159, filed May 22, 2019, 6 pages.
Written Opinion of the International Searching Authority dated Sep. 17, 2019, issued in corresponding International Application No. PCT/FR2019/051159, filed May 22, 2019, 6 pages.

* cited by examiner

ANGULAR SECTOR FOR TURBOMACHINE BLADING WITH IMPROVED SEALING

The invention relates to an angular sector of a turbomachine blading, in particular an angular sector of a blading such as a rectifier equipping a compressor or such as a stator equipping a turbine of this turbomachine.

BACKGROUND

Gas turbine engines comprise, in a known manner, fixed internal blading rings, which are mounted in external casings of a primary flow duct of the engine and which are axially interposed between compressor moving blading wheels or between turbine moving blading wheels of these engines. Each fixed blading ring is dynamically sealed around a compressor or turbine rotor. For this purpose, each fixed blading ring comprises an internal block of abradable material which is designed to cooperate with lip sealing elements that are rotationally integral with the associated compressor or turbine rotor to ensure gas-tightness.

Part of the gas is nevertheless likely to enter between the stationary and moving blading of the compressor or turbine rotors, in the opposite direction to the main flow circulating in the primary flow duct.

The fixed internal blading ring constitute rectifiers when they are interposed between compressor wheels, or constitute stators when they are interposed between turbine wheels.

In order to facilitate their assembly and reduce their manufacturing cost, the fixed blading rings are often made as an assembly of angular sectors that are juxtaposed next to each other to form a whole fixed blading ring. These rings thus leave an inter-sector clearance which leaves recirculation passages for the gases, no longer around the roots of the angular sectors, but between them.

Indeed, conventionally, part of the gases that pass through the fixed blading from upstream to downstream tend to recirculate from downstream to upstream through the seal that is made between the block of abradable material and the lip sealing element according to a leakage flow rate that we try to keep as minimal as possible, because it affects the performance of the corresponding compressor or turbine. Another part of the gas that passes through these blading from upstream to downstream tends to recirculate from downstream to upstream by insinuating itself between the sectors through the clearance between the sectors, also called the inter-sector clearance.

The difficulty in ensuring a satisfactory level of sealing lies in the fact that the angular sectors of the ring move due to the mechanical and thermal deformations that occur during engine operation. Thus, the inter-sector clearance and leakage flow rate vary during engine operation. Furthermore, the clearance under during hot engine operation must never be zero because contact between the sector platforms could cause ovalization of the casing, which is outside the fixed blading, and/or matting of the surfaces in contact, which could drastically increase the stresses exerted on the fixed blading, resulting in particular in a transfer of these stresses to the outer casing of the engine, which receives the fixed blading.

A transfer of these stresses could cause an ovalization of the outer casing and significantly modify the radial clearances between this casing and the adjacent moving blading, with a very negative impact on the engine in terms of service life.

Conventional sealing between two immediately adjacent angular sectors of a fixed blading ring is ensured by lip seal systems interposed between these sectors to limit leakage between sectors. These sealing systems can be used to seal ring sectors of the fixed blading in the primary flow duct, and also, in the case of a double-flow engine, to seal ring sectors of the fixed blading in the secondary flow duct.

In this technology, lips are housed between two adjacent sectors in housings that have been machined into the sectors. The lips are used to prevent the flow of gas of passing through the inter-sector clearance.

Conventionally, an angular sector of the blading ring comprises, with respect to the axis of the ring, a radially outer platform substantially in the shape of an angular section of a cylinder, a radially inner platform in the shape of an angular section of a cylinder, at least two vanes extending between said platforms, a root attached to the inner platform, and at least one block of abradable honeycomb material extending inwardly to the root. The lips interposed between two sectors are embedded in the mass of the two adjacent roots of the two sectors and in housings facing the adjacent interior and exterior platforms of the two sectors.

However, these lips are not easy to install. In addition, they require the construction of housings in the angular sectors of the fixed blading, which are expensive to manufacture.

In addition, the lips cannot be arranged along the entire radial thickness of the root for the sealing on the inside of the inner platform. Consequently, clearances remain between the sectors through which the gases can flow.

Therefore, there is a need for an alternative sealing technology to dispense with such lips and to improve the sealing between the fixed blading sectors.

Document FR-2.552.159-A1 describes a technology in which the edges of the inner platforms are shaped into a Z-profile. This configuration improves sealing efficiency, but is limited to the platforms and is only applicable to a dispenser with an unsectorized block of abradable material.

DISCLOSURE OF THE INVENTION

The invention proposes to take advantage of the existing abradable material block arranged inside the inner platform to provide a seal directly between transverse end walls of two adjacent angular sectors.

For this purpose, the invention proposes an angular sector of a fixed blading ring of a turbomachine, in particular of a rectifier or stator, said sector extending at a given angle around an axis of the fixed blading ring and comprising, relative to the axis of said fixed blading ring a radially outer platform, a radially inner platform, at least two vanes extending between said platforms, and at least one abradable honeycomb material block extending on the inside of the inner platform between transverse ends of the sector.

The abradable honeycomb material block comprises, for example, a radially inner radial sealing face which is configured to cooperate with lips of a labyrinth seal carried by a rotor of the turbomachine.

In accordance with the invention, this angular sector is characterized in that the abradable material block comprises at least one transverse end wall which is shaped according to a toothed profile comprising at least one tooth with a radial direction extending along an entire radial thickness of said block.

According to other characteristics of the angular sector:

the abradable material block extends to the inner platform, each at least one tooth projects transversely from said block and is made of said abradable honeycomb material of said block, the tooth profile has a sawtooth shape in cross-section in a plane perpendicular to the radial direction, the tooth profile has a crenellated shape in cross-section in a plane perpendicular to the radial direction, the tooth profile has a single tooth in the form of a pin, the single tooth in the form of a pin extends from one of the axial ends of the block, the abradable honeycomb material of the block comprises radially oriented tubular cells.

The invention also relates to an assembly of two adjacent angular sectors of the type described above, characterized in that said at least one transverse end wall shaped according to a toothed profile of said adjacent angular sectors faces each other, and in that said toothed profiles are complementary.

Finally, the invention concerns a fixed blading ring of a turbomachine comprising a plurality of angular sectors of the fixed blading ring, characterized in that it comprises a given number of sectors whose juxtaposition forms the entire fixed blading ring, in that each angular sector comprises two opposite transverse end walls which are shaped into toothed profiles each comprising at least one radially oriented tooth, and in that each angular sector is assembled with each of the angular sectors adjacent thereto in an assembly of the type described above.

DESCRIPTION OF THE FIGURES

The invention will be better understood and other details, characteristics and advantages of the present invention will appear more clearly when reading the following description made as an example, which is not limitative, and with reference to the appended drawings, in which.

DETAILED DESCRIPTION

In the following description, identical reference numbers refer to parts that are identical or have similar functions.

Axial direction means by extension any direction parallel to an axis A of a turbomachine, and radial direction means any direction perpendicular and extending radially with respect to the axial direction.

Figure 1:
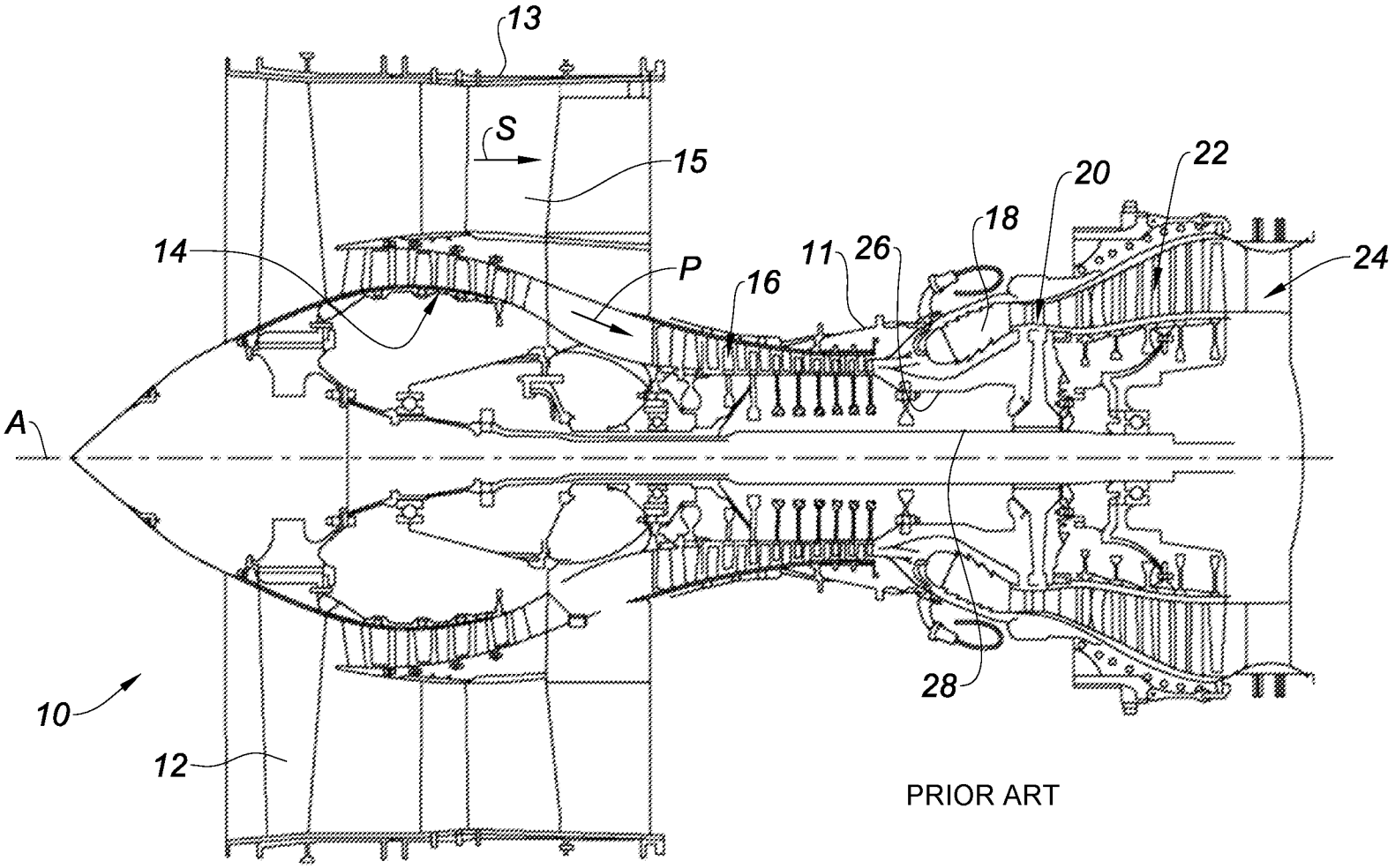
FIG. 1 is a schematic sectional view of a turbomachine according to the prior art.

FIG. 1 shows a turbomachine 10 of axis A of the double flow type. Such a turbomachine 10, here a turbojet engine 10, comprises in a known manner a fan 12, a low pressure (LP) compressor 14, a high pressure (HP) compressor 16, a combustion chamber 18, a high pressure (HP) turbine 20, a low pressure (LP) turbine 22 and an exhaust nozzle 24. The rotor of the HP compressor 16 and the rotor of the HP turbine 20 are connected by a HP high pressure shaft 26 and form a high pressure body with it. The rotor of the LP compressor 14 and the rotor of the LP low pressure turbine 22 are connected by a LP shaft 28 and form with it a low pressure body.

A primary air flow "P" passes through the high- and low-pressure bodies and fan 12 produces a secondary air flow "S" that circulates in the turbojet engine 10, between a casing 11 and an outer casing 13 of the turbojet engine, in a cold flow channel 15. At the outlet of the nozzle 24, the gases from the primary flow "P" are mixed with the secondary flow "S" to produce a propulsion force, the secondary flow "S" providing most of the thrust here.

Figure 2:
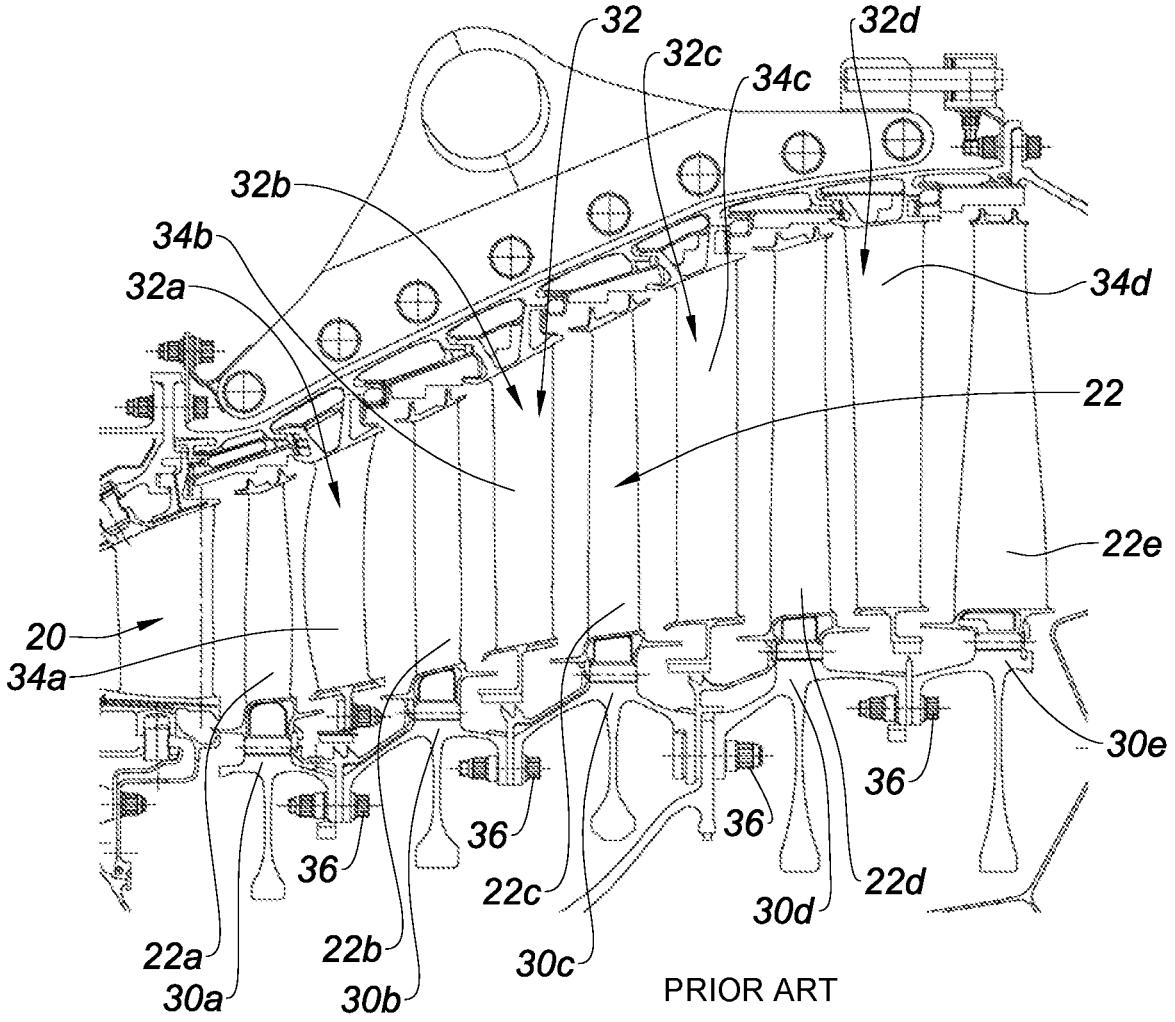
FIG. 2 is a detailed cross-sectional view of a turbine of the turbomachine of FIG. 1.

The LP and HP compressors 14, 16 and the HP and LP turbines 20, 22 each comprise several compressor or turbine stages respectively. As shown for example in FIG. 2, the LP turbine 22 comprises several turbine moving blading wheels 22*a*, 22*b*, 22*c*, 22*d*, 22*e* whose bladings are carried by associated shrouds 30*a*, 30*b*, 30*c*, 30*d*, 30*e* which are assembled together by bolts 36.

The LP turbine 22 also comprises rings of fixed bladings 32*a*, 32*b*, 32*c*, 32*d* of a diffuser 32 which are interposed between the turbine moving blading wheels 22*a*, 22*b*, 22*c*, 22*d*, 22*e*.

Each fixed blading ring 32*a*, 32*b*, 32*c*, 32*d* of the diffuser is formed by an assembly of sectors 34*a*, 34*b*, 34*c*, 34*d* of a fixed blading ring, assembled around the axis A of the turbomachine over 360° so as to constitute a complete fixed blading ring 32*a*, 32*b*, 32*c*, 32*d* around the axis A of the turbomachine.

In the same way, as illustrated in FIGS. 3 to 5B, the HP compressor 16 of the turbomachine 10 can comprise a series of compressor moving blading wheels 22*a*, 22*b* between which are interposed rings 32*a* of the fixed bladings of a rectifier which are themselves made in the form of an assembly of angular sectors 34*a* of fixed blading rings. It will therefore be understood that the invention applies to any assembly of angular sectors 34*a* of the fixed blading rings 32*a*, whether it is an assembly of angular sectors 34*a* of a rectifier for a compressor or angular sectors 34*a* of a diffuser for a turbine.

Figure 3:
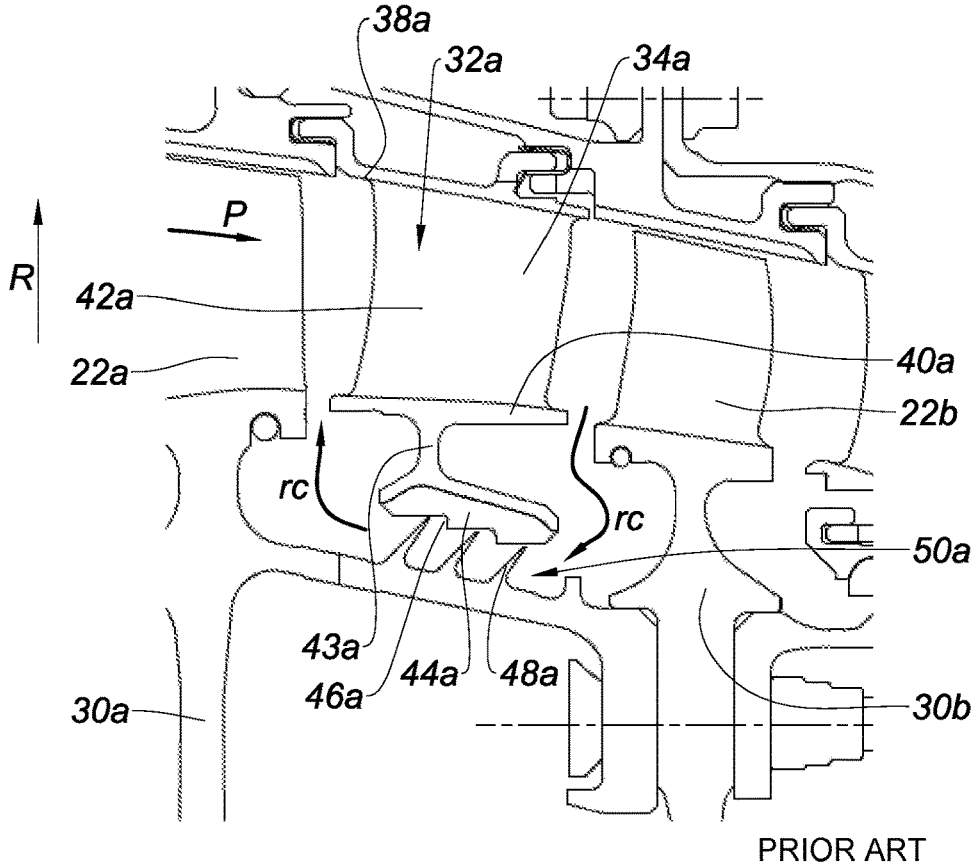
FIG. 3 is a detailed cross-sectional view of a compressor of the turbomachine in FIG. 1.

As illustrated in more detail in FIG. 3, a compressor fixed blading ring 32*a* consists of an assembly of angular sectors 34*a* of the blading ring. It can be seen that each fixed blading ring, and in particular ring 32*a*, is placed in the primary flow duct P forming a clearance with the adjacent compressor impellers 22*a* and 22*b*, and in particular with shrouds 30*a* and 30*b* of these impellers 22*a*, 22*b*. Part of the pressurized gases of the primary flow P, which flows from upstream to downstream, tends to insinuate itself between the shrouds 30*a* and 30*b* and the angular sector 34*a* to recirculate from downstream to upstream according to a recirculation flow rc, represented by the arrows in FIG. 3, which tends to bypass the angular sector 34*a*.

The existence of this recirculation flow rc is particularly penalizing. The recirculation flow rc tends to reduce the performance of the compressor, or similarly in the case of a turbine, the performance of the said turbine. This is why current designs tend to minimize this recirculation flow rc by equipping the angular sector 34*a* with sealing means with the shroud it surrounds.

As shown in FIG. 3, each sector 34*a* extends at a given angle around the axis of the ring 32*a*, which corresponds to the axis A of the turbomachine previously illustrated in FIG. 1.

The term "lower" refers to any position close to the axis A in the radial direction, while the term "upper" refers to any position further from the axis A in the radial direction than the lower position. Finally, by "transverse" is meant any plane or surface comprising the axis A and parallel to a sectional plane of a sector 34.

Conventionally, each sector 34*a* comprises, with respect to the axis A of the ring 32*a*, a radially outer platform 38*a*, a radially inner platform 40*a*, at least two vanes 42*a* which extend between said platforms 38*a*, 40*a*, a root 43*a* which extends radially inward from the inner platform 40*a* and at least one block 44*a* of abradable honeycomb material which therefore also extends inward to the inner platform 40*a* between transverse ends (not shown) of the angular sector 34*a*.

A radially inner radial sealing face 46*a* is configured to cooperate with lips 48*a* of a labyrinth seal 50*a* carried by a rotor of the turbomachine, here the shroud 30*a*.

This configuration significantly reduces the intensity of the recirculation flow rc circulating between the sector 34*a* and the shroud 30*a*. However, it has no influence on the recirculation flow between two adjacent sectors 34*a*.

Conventionally, the sealing between adjacent sectors 34*a* is achieved by means of lips (not shown) that are received in housings facing the adjacent sectors 34*a* and that are arranged between these sectors 34*a* to form a barrier to the recirculation flow rc between the sectors 34*a*. This configuration is particularly costly because it requires the creation of housings for the lips, especially in the roots 43*a*, and because it imposes particular assembly precautions, especially with regard to the sectors that are intended to close the entire blading during its assembly.

Figure 4:
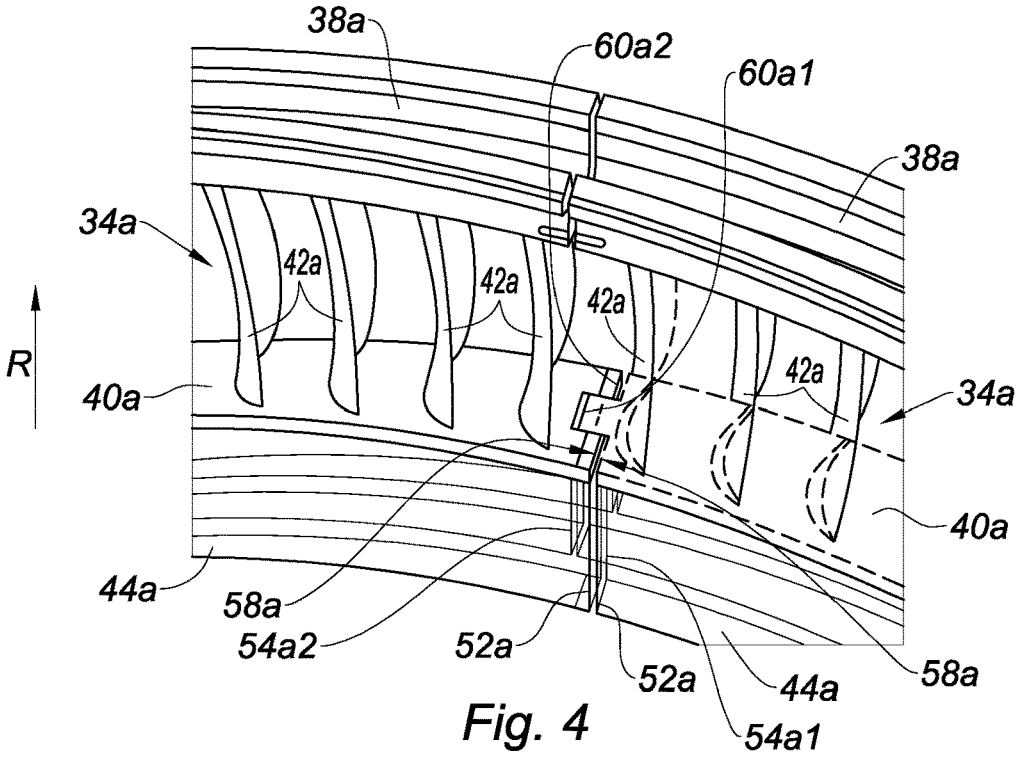
FIG. 4 is a perspective view of an assembly of angular blading sectors according to the invention.

As illustrated in FIG. 4, the invention proposes to simplify the sealing between the sectors 34*a* by taking advantage of the block 44*a* of abradable material already present radially inside the inner platform 40*a* so as to ensure a sealing directly between transverse end walls of two adjacent angular sectors.

For this purpose, as illustrated in FIG. 4, the invention proposes an angular sector 34*a* of a turbomachine fixed blading ring of the type described above, characterized in that the block 44*a* of abradable material comprises at least one transverse end wall 52*a* which is shaped according to a toothed profile 54*a*1, 54*a*2 comprising at least one tooth 56*a*1, 56*a*2 with a radial direction R, said at least one radial tooth 56*a*1, 56*a*2 extending along an entire radial thickness of said block 44*a*.

Thus, FIG. 4 shows an assembly of two angular sectors 34*a* of a fixed blading ring. Each of these two angular sectors 34*a* of the fixed blading ring comprises a transverse end wall 52*a* which faces the transverse end wall 52*a* of the other sector 34*a* of the fixed blading ring.

Figure 6:
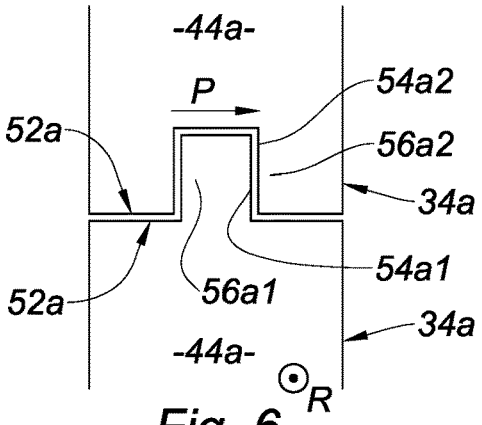
FIG. 6 is a schematic cross-sectional view of a first tooth profile of an abradable material block of a blading ring sector according to the invention.

As shown in particular in FIG. 6, the block 44*a* of one of the sectors 34*a* comprise a tooth profile 54*a*1 comprising at least one tooth 56*a*1 and the block 44*a* of the other of the sectors 34*a* comprises a tooth profile 54*a*2, complementary to the tooth profile 54*a*1, with at least one tooth 56*a*1. Sealing is thus ensured in the opposite direction to the primary flow P by the cooperation of the transverse end walls 52*a* and their complementary tooth profiles 54*a*1 and 54*a*2.

The fixed blading ring 32*a* comprises a specific number of ring sectors 34*a*, the juxtaposition of which forms the entire fixed blading ring 32*a* and it comprises at least two of these angular sectors 34*a* of the blading ring comprising complementary tooth profiles 54*a*1, 54*a*2. It is to be understood that all ring sectors 34*a* preferably comprise toothed profiles. Thus, each angular sector 34*a* is assembled with each of the adjacent angular sectors 34*a* in an assembly of the type described above, and each block 44*a* comprises at both ends opposite transverse end walls 52*a* which are shaped according to toothed profiles 54*a*1, 54*a*2 intended to cooperate with the toothed profiles 54*a*1, 54*a*2 with radially oriented teeth of the adjacent blocks 44*a*.

Figure 5A:
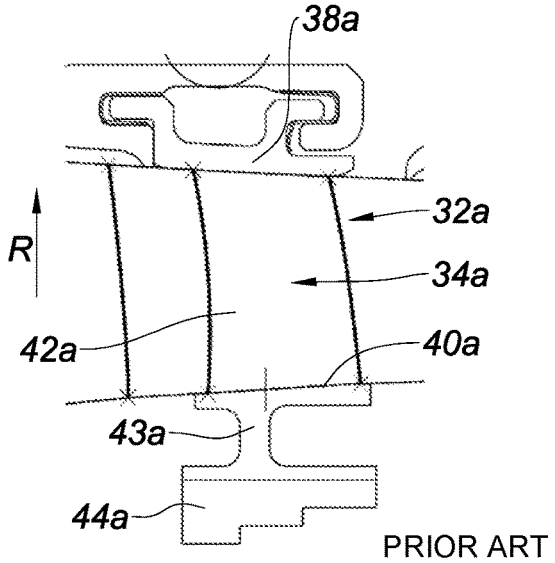
FIG. 5A is a sectional view of a blading ring sector according to the prior art.
Figure 5B:
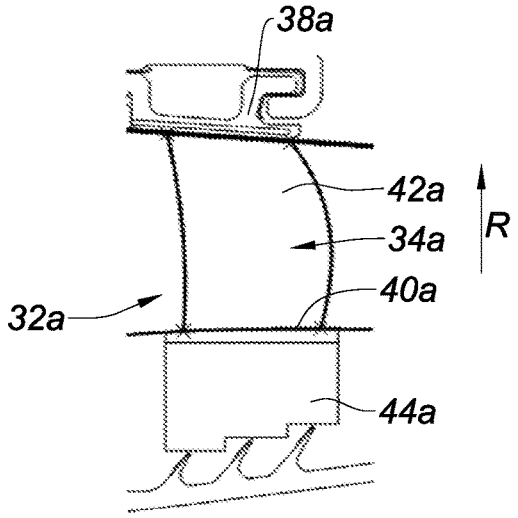
FIG. 5B is a sectional view of a blading ring sector according to the invention.

In the preferred embodiment of the invention, the abradable material block 44*a* of the sector 34*a* extends to the inner platform 40*a*. This configuration has been shown in FIG. 5B. Compared to a conventional angular sector 34*a* as shown in FIG. 5A, the root 43*a* has been removed and the block 44*a* of honeycomb material has been extended radially to the inner platform 40*a* so as to impart maximum height to the block 44*a* of honeycomb material, thereby providing maximum sealing. Furthermore, this configuration eliminates the need for a conventional lip and groove sealing system on the root 43*a*.

Preferably, as shown in FIG. 4, each inner platform 40*a* has an end edge 58*a* which is shaped into a toothed profile 60*a*1, 60*a*2 which is superimposed on the toothed profile 54*a*1, 54*a*2 of the corresponding honeycomb material block 44*a*. Thus the toothed profiles 60*a*1, 60*a*2 are also complementary to each other. However, this configuration is not limiting the invention, and the end edges 58*a* of the inner platforms 40*a* could be straight.

Each tooth 56*a*1 or 56*a*2 of each block 44*a* can be made in different ways. For example, teeth 56*a*1 or 56*a*2 could be attached to block 44*a*, provided they protrude from the block 44*a*. However, each tooth 56*a*1 or 56*a*2 is preferably made directly from the abradable honeycomb material of the block 44*a*.

The tooth profile 54*a*1, 54*a*2 of the honeycomb material block 44*a* can be configured in different ways, depending on the desired seal. The higher the number of teeth 56*a*1 or 56*a*2, the better the profile 54*a*1, 54*a*2 is able to provide a labyrinth that effectively reduces the flow rate of the recirculating flow rc between adjacent angular sectors 44*a*. On the other hand, the higher the number of teeth 56*a*1 or 56*a*2, the more the fitting tolerances of two adjacent angular sectors 44*a* are reduced and the more complex these adjacent sectors 44*a* are to achieve. It will therefore be understood that the number of teeth 56*a*1 or 56*a*2 will be the result of a compromise between the efficiency of the reduction of the recirculating flow rc and the cost of obtaining the ring 32*a* formed of the angular sectors 34*a*, this cost including the realization of these sectors 34*a* and their assembly.

Figures 7, 8, 9:
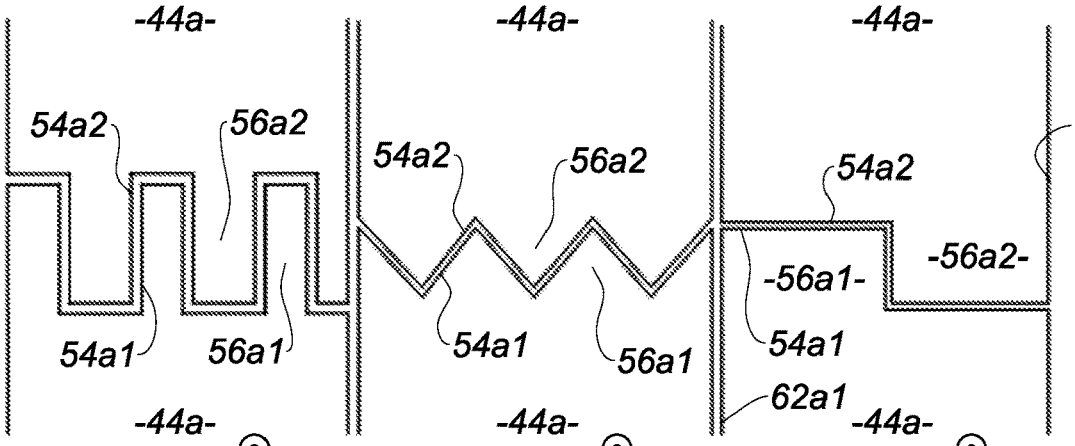
FIG. 7 is a schematic sectional view of a second tooth profile of an abradable material block of a blading ring sector according to the invention.
FIG. 8 is a schematic cross-sectional view of a third tooth profile of an abradable material block of a blading ring sector according to the invention.
FIG. 9 is a schematic cross-sectional view of a fourth tooth profile of an abradable material block of a blading ring sector according to the invention.

In this configuration, as shown in FIGS. 6 and 7, the tooth profile 54*a*1, 54*a*2 can present, in section in a plane perpendicular to a radial direction R, a crenellated shape, i.e. with teeth of substantially rectangular or square section.

Alternatively, as shown in FIG. 8, the toothed profile 54*a*1, 54*a*2 can have a sawtooth shape in cross-section in a plane perpendicular to the radial direction R.

Alternatively, as shown in FIG. 9, the tooth profile 54*a*1, 54*a*2 of each sector 44*a* may comprise a pin which forms the single tooth 56*a*1, 56*a*2. In this case, the single tooth 56*a*1, 56*a*2 shaped as a pin extends from one of the axial ends 62*a*1 or 62*a*2 of the block 44*a*.

Although this configuration is not limiting the invention, it will be understood that the abradable honeycomb material of the block 44*a* comprises tubular cells (not shown) that are radially oriented in the radial direction R. This configuration provides maximum strength to the block 44*a* of material.

In the preferred embodiment of the invention, the honeycomb material of the block 44*a* is obtained by an additive manufacturing process. This configuration allows for the formation of regular cells and a regular conformation of the tooth profiles 54*a*1, 54*a*2 without any risk of deterioration as might be caused by a material removal process.

The invention thus makes it possible to ensure the sealing between angular sectors 32*a* of the fixed blading ring in a simple and effective manner, and to limit the flow rate of the recirculation flow rc between these angular sectors 32*a*, which allows to improve the performance of a compressor or a turbine equipped with such angular sectors of the blading ring 32*a* in a consequent manner.

The invention claimed is:

1. A fixed blading ring of a turbomachine made of multiple angular sectors, each angular sector extending at a given angle around an axis A of the fixed blading ring and comprising, relative to the axis A, a radially outer platform, a radially inner platform, at least two vanes extending between said radially outer and radially inner platforms, and one honeycomb structure extending between transverse ends of each sector, said honeycomb structure comprising at least one abradable honeycomb material block extending on an inside of the radially inner platform between the transverse ends of said angular sector, wherein the abradable honeycomb material block comprises at least one transverse end wall shaped according to a toothed profile comprising at least one tooth with a radial direction, said at least one tooth extending along an entire radial thickness of said abradable honeycomb material block.

2. The fixed blading ring according to claim 1, wherein the abradable honeycomb material block extends to the radially inner platform.

3. The fixed blading ring according to claim 1, wherein the at least one tooth projects transversely from said abradable honeycomb material block and is made of an abradable honeycomb material of said abradable honeycomb material block.

4. The fixed blading ring according to claim 1, wherein the toothed profile has a sawtooth cross-sectional shape in a plane perpendicular to the radial direction.

5. The fixed blading ring according to claim 1, wherein the toothed profile has a crenellated cross-sectional shape in a plane perpendicular to the radial direction.

6. The fixed blading ring according to claim 1, wherein the toothed profile has a single tooth in the form of a pin.

7. The fixed blading ring according to claim 6, wherein the single tooth extends from an axial end wall of the abradable honeycomb material block.

8. The fixed blading ring according to claim 1, wherein an abradable honeycomb material of the abradable honeycomb material block comprises radially oriented tubular cells.

9. The fixed blading ring according to claim 1, wherein said at least one transverse end walls of two adjacent angular sectors face each other, and wherein said toothed profiles of said two adjacent angular sectors are complementary.

10. The fixed blading ring of claim 9, wherein each angular sector comprises two opposite transverse end walls which are shaped into toothed profiles, each toothed profile comprising at least one radially oriented tooth, and wherein each angular sector is assembled with each of the angular sectors adjacent thereto.

* * * * *